US010161711B2

(12) United States Patent
Moretti

(10) Patent No.: US 10,161,711 B2
(45) Date of Patent: Dec. 25, 2018

(54) PORTABLE FIREARM WITH QUICK COUPLING REMOVABLE STOCK

(71) Applicant: BENELLI ARMI S.P.A., Urbino (Pesaro Urbino) (IT)

(72) Inventor: Luigi Moretti, Collebeato (IT)

(73) Assignee: BENELLI ARMI, S.P.A., Pesaro, Urbino (IT)

( * ) Notice: Subject to any disclaimer, the term of this patent is extended or adjusted under 35 U.S.C. 154(b) by 0 days.

(21) Appl. No.: 15/824,439

(22) Filed: Nov. 28, 2017

(65) Prior Publication Data

US 2018/0156567 A1 Jun. 7, 2018

(30) Foreign Application Priority Data

Dec. 1, 2016 (IT) ..... 102016000122160

(51) Int. Cl.
*F41C 23/14* (2006.01)
*F41C 23/04* (2006.01)

(52) U.S. Cl.
CPC ..... *F41C 23/04* (2013.01); *F41C 23/14* (2013.01)

(58) Field of Classification Search
CPC ..... F41C 23/04; F41C 23/12; F41C 23/14; F41C 23/20; F41C 23/00; F41A 11/02; F41A 11/04; F41A 11/06
See application file for complete search history.

(56) References Cited

U.S. PATENT DOCUMENTS 593,890 A 11/1897 Houston
2,807,113 A * 9/1957 Ivy ..... F41A 3/12 42/16
3,432,955 A * 3/1969 Vartanian ..... F41A 3/72 42/16
3,442,042 A * 5/1969 Van Tyle Gilbert .... F41C 23/00 42/71.01
3,570,162 A * 3/1971 Suddarth ..... F41C 23/04 42/72
3,798,819 A * 3/1974 Hillberg ..... F41C 23/00 42/71.01
3,816,950 A * 6/1974 Vesamaa ..... F41A 3/72 42/16
5,173,564 A 12/1992 Hammond
(Continued)

FOREIGN PATENT DOCUMENTS

JP 2008 008525 A 1/2008

*Primary Examiner* — Derrick R Morgan
(74) *Attorney, Agent, or Firm* — R. Neil Sudol; Henry D. Coleman

(57) ABSTRACT

A portable firearm with quick coupling removable stock comprising a firearm body, provided with a grip, and a removable stock, which can be associated with the firearm body by means of a quick coupling device; the quick coupling device includes a hollow body, which is fixed to the firearm body, and an elongated body, which is integral with the stock and can be at least partially inserted in the hollow body; the device includes an interference member adapted to lock the elongated body in the hollow body in a locking position; the interference member is movable from the locking position to a release position in which the elongated body is movable and can be extracted from the hollow body. The interference member can be actuated easily by using a component of the firearm itself as a tool.

7 Claims, 5 Drawing Sheets

(56) References Cited

U.S. PATENT DOCUMENTS

| | | | | |
|---|---|---|---|---|
| 6,230,430 | B1 * | 5/2001 | Gosselin | F41C 27/00 42/90 |
| 7,395,819 | B2 * | 7/2008 | Dobbins | F41A 19/12 124/71 |
| 7,398,616 | B1 * | 7/2008 | Weir | F41C 23/04 42/71.01 |
| 7,793,453 | B1 | 9/2010 | Sewell et al. | |
| 7,802,392 | B2 * | 9/2010 | Peterson | F41A 11/02 42/124 |
| 8,186,090 | B1 * | 5/2012 | Chiarolanza | F41C 23/14 42/73 |
| 8,955,245 | B2 * | 2/2015 | Chvala | F41C 23/14 42/1.06 |
| 9,091,505 | B1 * | 7/2015 | Battaglia | F41C 23/20 |
| 9,417,032 | B1 * | 8/2016 | Chiang | F41C 23/14 |
| 9,448,027 | B1 * | 9/2016 | Zinsner | F41A 21/482 |
| 9,612,082 | B2 * | 4/2017 | Cottle | F41C 23/14 |
| 9,612,083 | B2 * | 4/2017 | Cottle | F41C 23/14 |
| 9,664,476 | B1 * | 5/2017 | Robinson | F41C 23/04 |
| 9,664,477 | B1 * | 5/2017 | Reavis, III | F41C 27/22 |
| 9,664,478 | B2 * | 5/2017 | Robinson | F41C 23/14 |
| 9,664,479 | B1 * | 5/2017 | Robinson | F41C 23/14 |
| 9,671,193 | B2 * | 6/2017 | Chiang | F41C 23/14 |
| 9,772,160 | B2 * | 9/2017 | Sain | F41C 27/00 |
| 9,897,406 | B2 * | 2/2018 | Oz | F41A 11/02 |
| 9,915,498 | B1 * | 3/2018 | Spuhr | F41C 23/14 |
| 2002/0050088 | A1 * | 5/2002 | Sharp | F41A 23/10 42/73 |
| 2010/0132240 | A1 * | 6/2010 | Webber | F41A 11/02 42/75.03 |
| 2013/0111799 | A1 * | 5/2013 | Lee | F41C 27/00 42/106 |
| 2013/0232841 | A1 * | 9/2013 | Knoebel | F41C 23/16 42/71.01 |
| 2015/0052795 | A1 | 2/2015 | Burke et al. | |
| 2015/0323283 | A1 | 11/2015 | Huntley | |
| 2016/0018184 | A1 * | 1/2016 | Park | F41C 23/20 42/73 |
| 2016/0084612 | A1 * | 3/2016 | Robinson | F41C 23/14 42/73 |
| 2016/0097613 | A1 | 4/2016 | Lamb | |
| 2017/0115093 | A1 * | 4/2017 | Chiang | F41C 23/14 |
| 2017/0205187 | A1 * | 7/2017 | Brown | F41C 23/04 |
| 2017/0320204 | A1 * | 11/2017 | Bates | B25B 31/00 |

* cited by examiner

PORTABLE FIREARM WITH QUICK COUPLING REMOVABLE STOCK

BACKGROUND OF THE INVENTION

The present invention relates to a portable firearm with quick coupling removable stock.

Many different types of removable or collapsible stocks for rifles and portable firearms in general are known.

For example, U.S. Pat. No. 5,173,564 discloses a system that provides a coupling which is fixed to the body of the firearm and is adapted to receive an extension of the stock which is locked by a bolt.

U.S. Pat. No. 7,793,453 discloses a rapidly adjustable telescopic stock.

US2009/028718 discloses an adapter to be applied to a rifle to fix an to interchangeable stock to any firearm.

US2016097613 discloses a storage compartment having a bracket portion configured to join with a buffer tube portion of a firearm.

A common problem of the prior art systems is to provide a structure that is constructively simple and at the same time easy to use.

Known structures have either the drawback of complicated construction, with corresponding high production costs and reduced reliability, or less than optimum functionality caused by complicated operations for the assembly and disassembly of the stock, which are due for example to the need to use external tools to assemble and disassemble the stock with respect to the firearm.

OBJECTS OF THE INVENTION

The aim of the present invention is to provide a portable firearm that has a stock that can be removed by means of a quick coupling device that is structurally simple and at the same time easy to use.

Within the scope of this aim, an object of the invention is to provide a quick coupling device that is strong and suitable for various types of firearm.

Another object of the invention is to provide a quick coupling device which, by virtue of its particular constructive characteristics, is capable of giving the greatest assurances of reliability and safety in use.

SUMMARY OF THE INVENTION

This aim, these objects and others which will become better apparent hereinafter are achieved by a portable firearm with quick coupling removable stock comprising a firearm body, provided with a grip, and a removable stock, which can be associated with said firearm body by means of a quick coupling device; said quick coupling device comprising a hollow body, which is fixed to said firearm body, and an elongated body, which is integral with said stock and can be at least partially inserted in said hollow body; said device comprising an interference member adapted to lock said elongated body in said hollow body in a locking position; said interference member being movable from said locking position to a release position in which said elongated body is movable and can be extracted from said hollow body; said operation for disengaging said end of said piston from said hole is performed with a tool constituted by a component of said firearm.

BRIEF DESCRIPTION OF THE INVENTION

Further characteristics and advantages will become better apparent from the description of preferred but not exclusive embodiments of the invention, illustrated by way of non-limiting example in the accompanying drawings, wherein.

DETAIL DESCRIPTION

Figure 1:
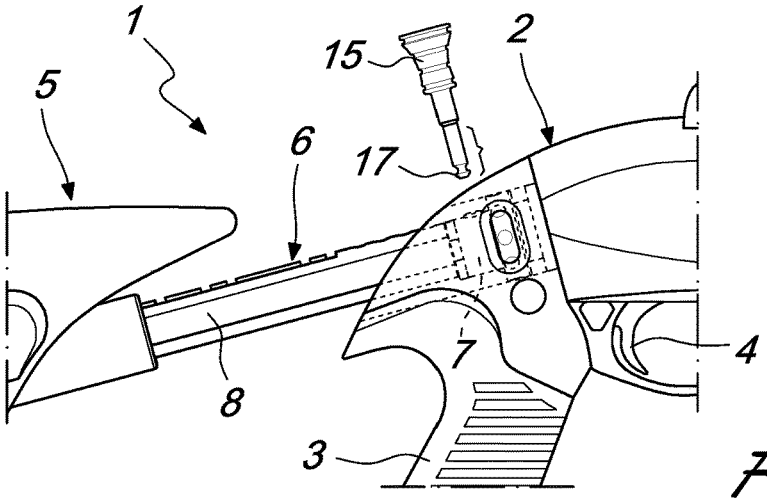
FIG. 1 is a side view of a portable firearm with quick coupling removable stock, according to the present invention.
Figure 2:
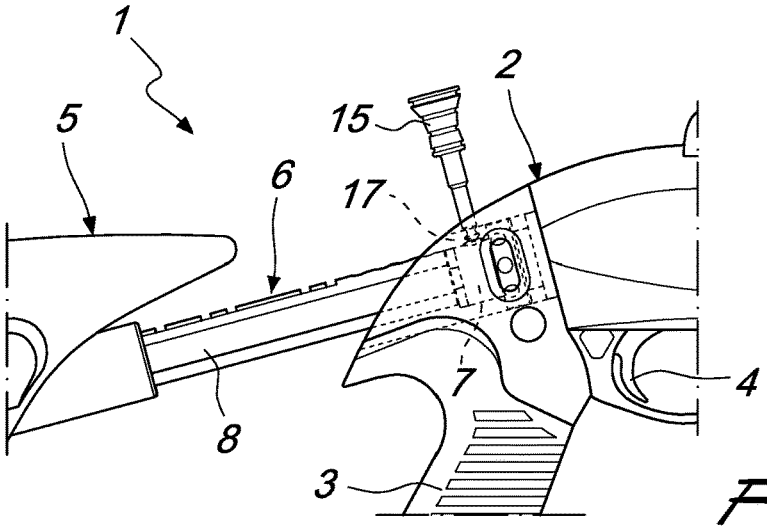
FIG. 2 is a view, similar to the preceding one, illustrating the operation of releasing the stock from the body of the firearm.
Figure 3:
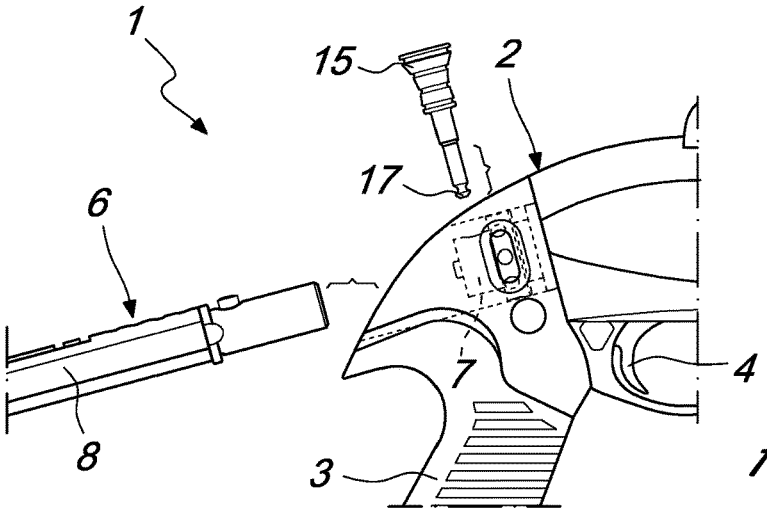
FIG. 3 is a view, similar to the preceding one, illustrating the stock separated from the body of the firearm.

With reference to the cited figures, the portable firearm according to the invention, globally designated by the reference numeral 1, has a firearm body 2 provided with a grip 3 at a trigger 4.

The firearm 1 has a removable stock 5, which is associated with the firearm body 2 by means of a quick coupling device, globally designated by the reference numeral 6.

The quick coupling device 6 according to the present invention includes a hollow body 7, which is fixed to the firearm body 2, an elongated body 8, which is integral with the stock 5 and can be inserted at least partially in the hollow body 7, and an interference member 9, which can lock the elongated body. 8 in the hollow body 7.

The interference member 9 has a piston 10 which moves in contrast with a contrast spring 11 in a seat 12 formed in the elongated body 8.

The piston 10 has an end 13 that is adapted to engage a hole 14 formed in the hollow body 7.

Figure 6:
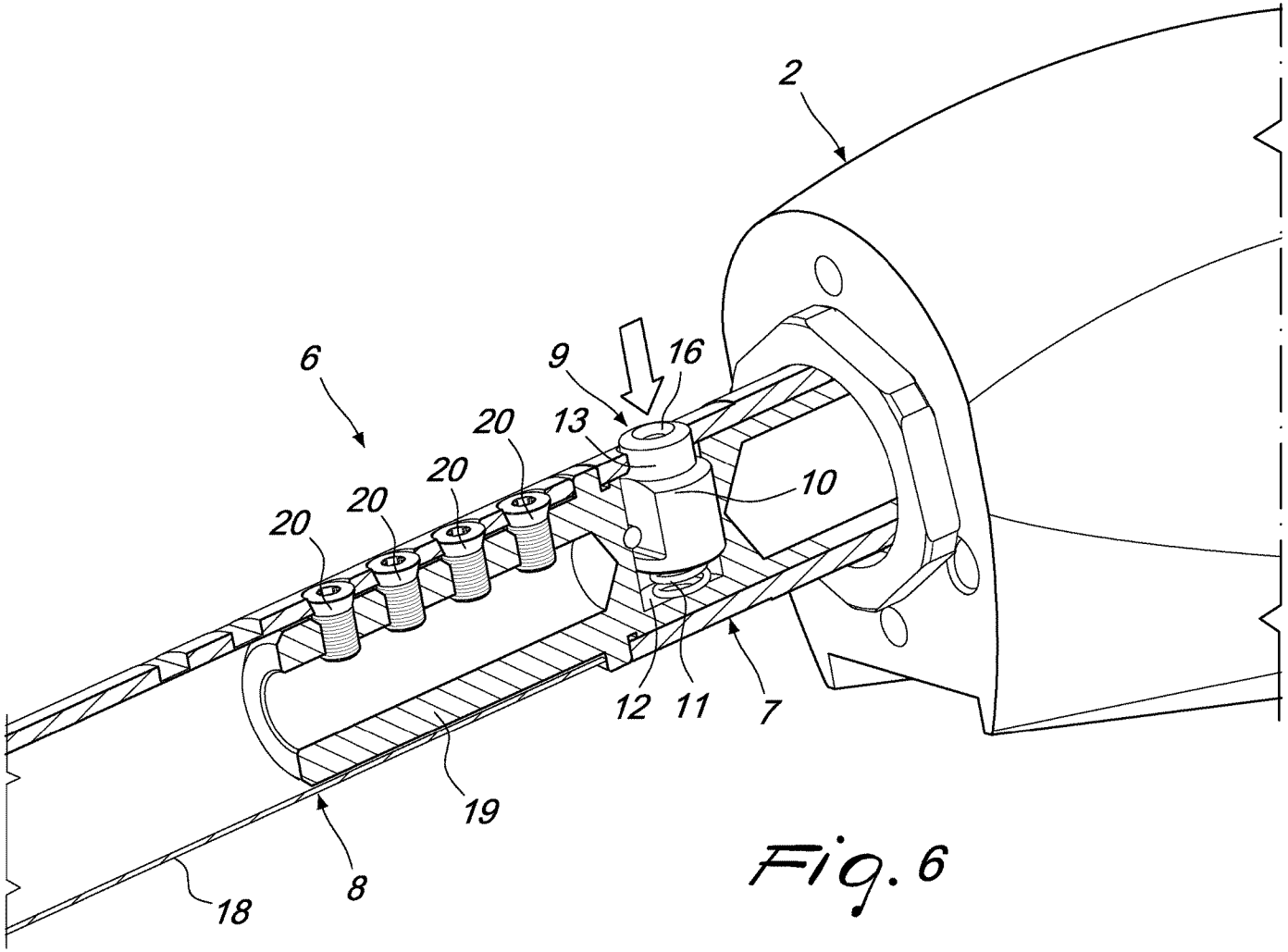
FIG. 6 is a partially cutout perspective view of the rear part of the firearm body, showing the quick coupling device according to the present invention.
Figure 7:
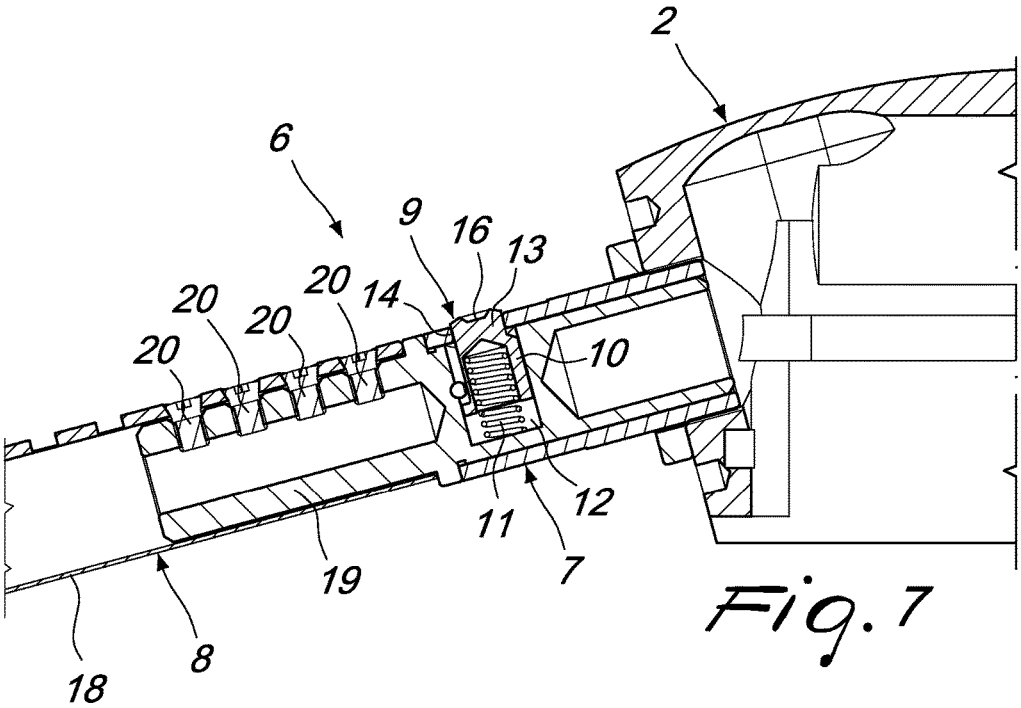
FIG. 7 is a longitudinally sectioned side view of the rear part of the firearm body and of the quick coupling device according to the present invention, showing the stock engaged.

In a locking position, wherein the stock 5 is locked in the firearm body 2, the contrast spring 11 normally biases the piston 10 into an engaged position wherein the end 13 is engaged in the hole 14, preventing the movement of the elongated body 8 in the hollow body 7. This engaged position is visible in FIGS. 6 and 7.

By pressing on the end 13 of the piston 10, overcoming the force of the spring 11, the end is disengaged from the hole 14, allowing the sliding of the elongated body 8 in the hollow body 7 thus disconnecting the stock 5 from the firearm body 2.

Figure 8:
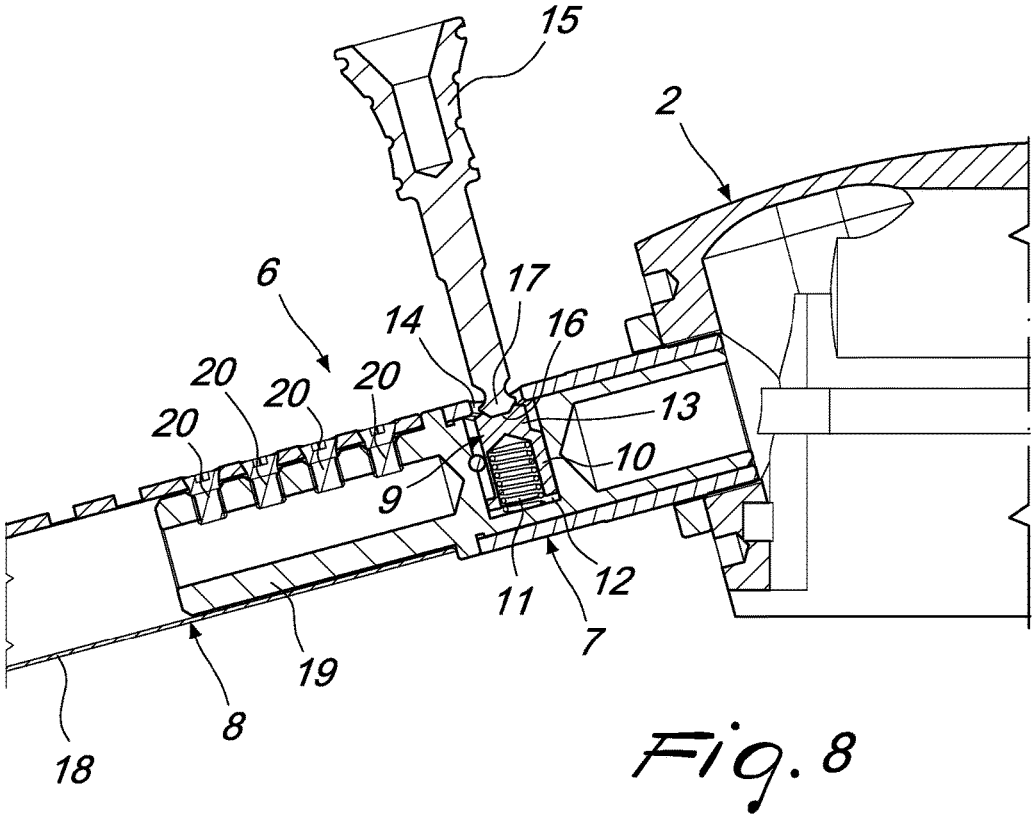
FIG. 8 is a view, similar to the preceding one, showing how the locking key of the device is operated.
Figure 9:
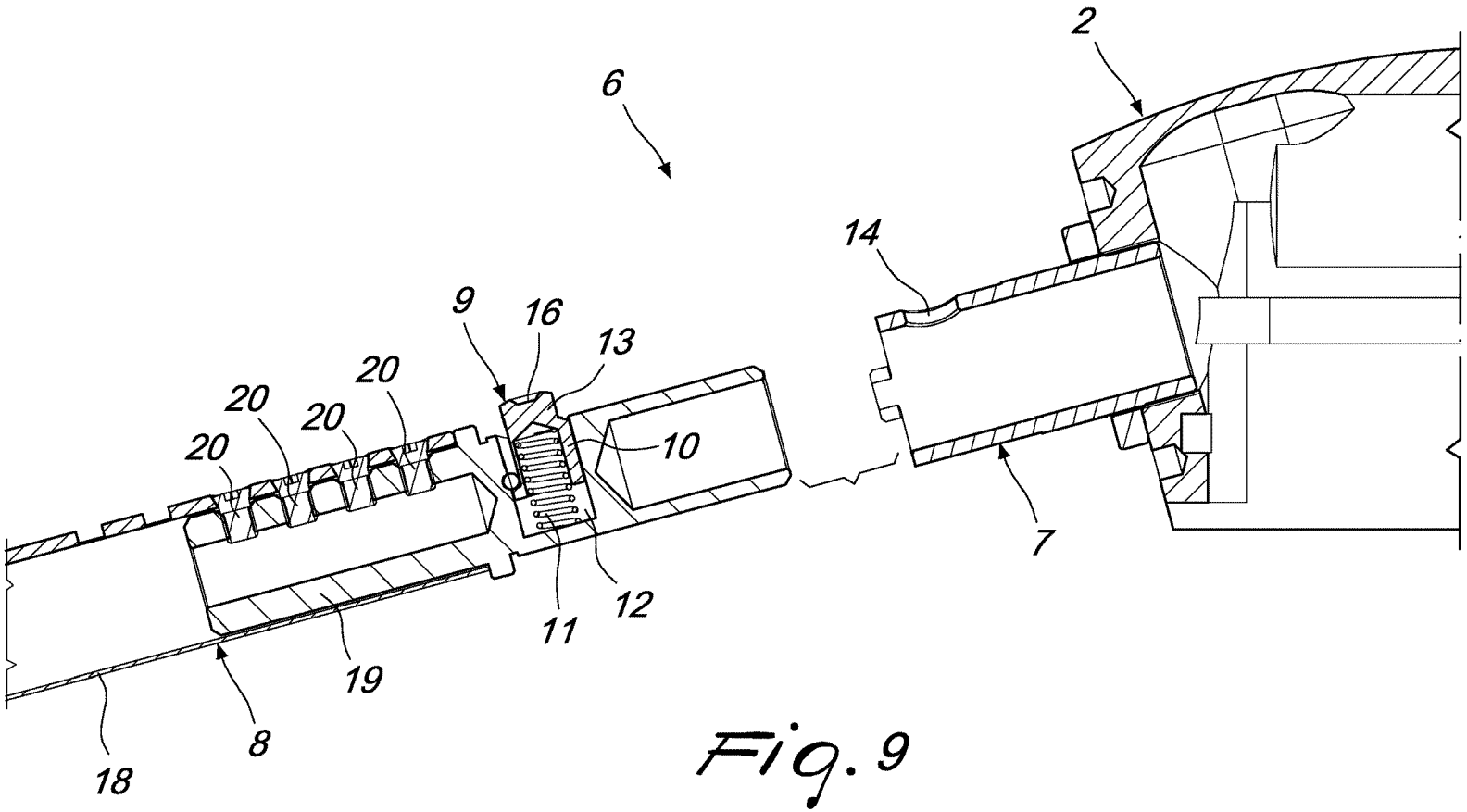
FIG. 9 is a longitudinally sectioned view of the rear part of the firearm body and of the quick coupling device in the condition in which the stock is separated from the firearm body.

FIG. 8 shows the operation for disengagement of the end 13 from the hole 14 that is performed with a tool 15.

Advantageously, the tool 15 is constituted by the cocking handle of the arm itself.

Advantageously, the end 13 of the piston 10 is provided with a recess 16 which accommodates the tip 17 of the stem of the cocking handle 15.

Preferably, the elongated body 8 is telescopic and is constituted by a tubular body 18 and by a central body 19 which can slide in the tubular body.

The central body 19 can be fixed in the tubular body 18 in different positions, by means of a series of screws 20 which can engage in seats formed in the central body 19.

The constructive example described herein relates to a rifle provided with a pistol grip and the quick coupling device of the stock of the rifle is arranged at the upper part of the grip of the firearm and is integral with the stock itself.

The device according to the present invention allows the user to disassemble the stock quickly for operations for maintenance, cleaning, etc.

The device also allows to disassemble the stock without special tools but simply by using the stem of the cocking handle of the rifle that is already mounted on the firearm.

Figure 4:
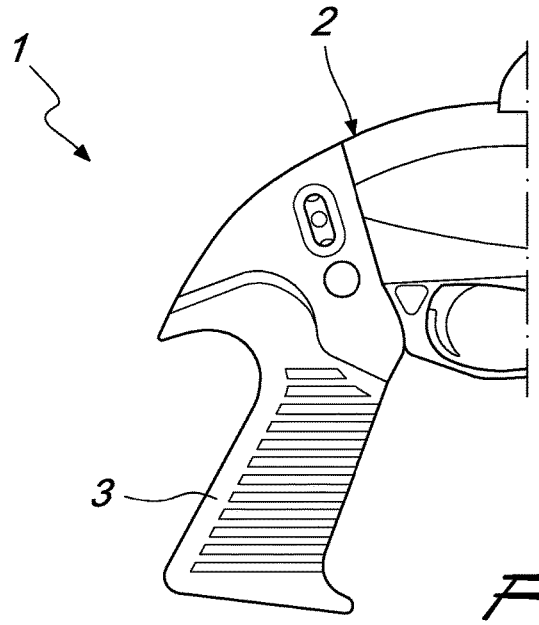
FIG. 4 is a side view of a firearm without a stock.
Figure 5:
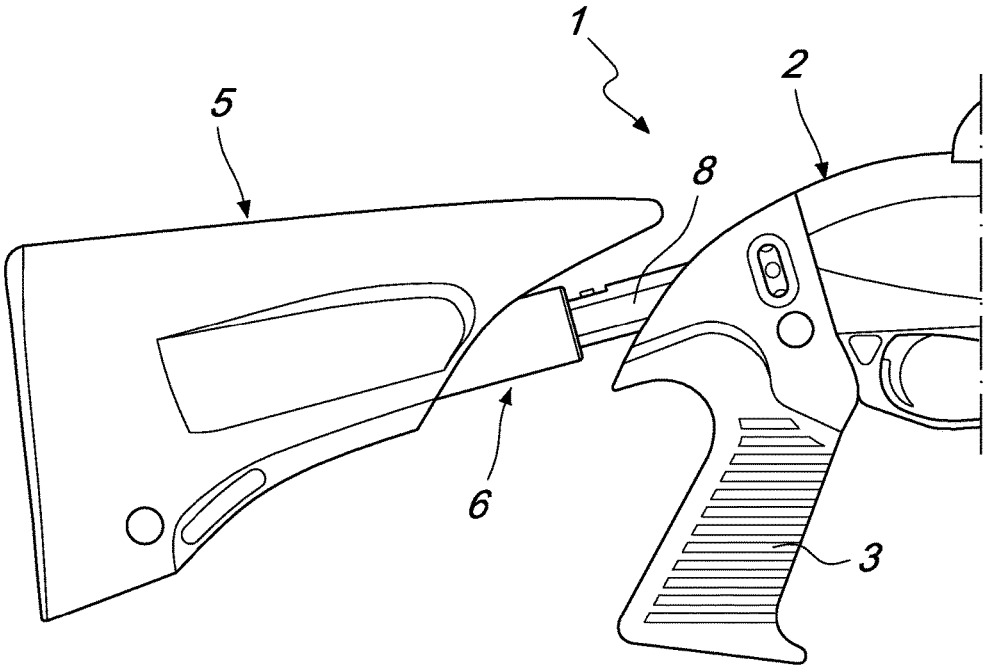
FIG. 5 is a view, similar to the preceding one, showing the same firearm with the stock engaged.

The quick coupling device allows to personalize the grip of the rifle by using only the pistol grip, as visible in FIG. 4, or the pistol grip together with the stock, as in FIG. 5.

The operation of the quick release system is based on the interference that the piston 10 has with respect to the hollow body 7 fixed on the body 2.

In order to detach the two ends of the release system it is sufficient to press the cocking handle of the rifle on the piston 10, until the interference is eliminated, and then move apart the two ends that are integral respectively with the stock and with the barrel.

According to the present invention, a functional component of the firearm is specifically designed to double as tool for operating the quick release system.

Namely, the cocking handle and the engagement means are configured in order to be able to use the cocking handle as an operating tool. In practice it has been found that the invention achieves the intended aim and objects.

The firearm according to the invention is susceptible of numerous modifications and variations, all of which are within the scope of the inventive concept; all the details may furthermore be replaced with technically equivalent elements.

The materials used, as well as the dimensions, may of course be any according to the requirements and the state of the art.

This application claims the priority of Italian Patent Application No. 102016000122160, filed on Dec. 1, 2016, the subject matter of which is incorporated herein by reference.

The invention claimed is:

1. A portable firearm with a quick coupling removable stock, said firearm comprising a firearm body, provided with a grip, and a removable stock, which can be associated with said firearm body by means of a quick coupling device, said firearm having a cocking handle with a stem; said quick coupling device comprising a hollow body, which is fixed to said firearm body, and an elongated body, which is integral with said stock and can be at least partially inserted in said hollow body; said quick coupling device further comprising an interference member adapted to lock said elongated body in said hollow body in a locking position, said interference member comprising a piston which moves in opposition to a force exerted by a contrast or compression spring in a seat formed in said elongated body, said piston having an end adapted to engage a hole formed in said hollow body, in said locking position said contrast or compression spring pushing said piston into a position for engaging said end in said hole of said hollow body, thereby preventing the movement of said elongated body in said hollow body; said interference member being movable from said locking position to a release position in which said elongated body is movable and can be extracted from said hollow body, said release position being obtainable by pressing on said end of said piston, overcoming the force of said contrast or compression spring and disengaging said end from said hole, thereby allowing a sliding of said elongated body in said hollow body and a disconnecting of said stock from said firearm body, said end of said piston having a recess configured to accommodate a tip of said stem of the cocking handle for disengaging said end of said piston from said hole.

2. A portable firearm with quick coupling removable stock, said firearm comprising a firearm body, provided with a grip, and a removable stock, which can be associated with said firearm body by means of a quick coupling device; said quick coupling device comprising a hollow body, which is fixed to said firearm body, and an elongated body, which is integral with said stock and can be at least partially inserted in said hollow body; said quick coupling device further comprising an interference member adapted to lock said elongated body in said hollow body in a locking position, wherein said elongated body is telescopic and is constituted by a tubular body and by a central body that can slide in said tubular body; said central body being fixed in said tubular body in different positions by means of a series of screws that can engage in seats formed in said central body.

3. The firearm according to claim 2, wherein said interference member comprises a piston which moves in opposition to a force exerted by a contrast or compression spring in a seat formed in said elongated body.

4. The firearm according to claim 3, wherein said piston is provided with an end adapted to engage a hole formed in said hollow body.

5. The firearm according to claim 4, wherein, in said locking position, said contrast or compression spring pushes said piston into a position for engaging said end in said hole of said hollow body, preventing the movement of said elongated body in said hollow body.

6. The firearm according to claim 5, wherein said release position is obtained by pressing on said end of said piston, overcoming the force of said contrast or compression spring and disengaging said end from said hole, thereby allowing a sliding of said elongated body in said hollow body and a disconnecting of said stock from said firearm body.

7. The firearm according to claim 6, wherein said firearm had a cocking handle with a stem and wherein said end of said piston has a recess that is configured to accommodate a tip of said stem of the cocking handle.

* * * * *